US005984135A

United States Patent [19]

Brown

[11] Patent Number: 5,984,135

[45] Date of Patent: Nov. 16, 1999

[54] DISPOSABLE ADHERING BEVERAGE CONTAINER COVER

[76] Inventor: Norma Brown, 2721 Kings Highway, apt. 4M, Brooklyn, N.Y. 11229

[21] Appl. No.: 09/128,616

[22] Filed: Aug. 3, 1998

[51] Int. Cl.[6] ..... A47G 19/22; B65D 51/24

[52] U.S. Cl. ..... 220/708; 220/521; 220/522; 220/254; 220/257; 220/258; 220/359.2; 220/709

[58] Field of Search ..... 220/254, 256, 220/257, 258, 780, 359.1, 359.2, 359.3, 703, 705, 708, 709, 521, 522, 212

[56] References Cited

U.S. PATENT DOCUMENTS

| | | | |
|---|---|---|---|
| 3,874,554 | 4/1975 | Chang | 220/708 |
| 4,095,710 | 6/1978 | Tomiati | 220/708 |
| 4,246,717 | 1/1981 | Wachtel | 446/19 |
| 4,247,016 | 1/1981 | Shaw . | |
| 4,407,429 | 10/1983 | Hekal | 220/395.2 |
| 4,615,457 | 10/1986 | Harding . | |
| 4,708,257 | 11/1987 | Deline | 220/257 |
| 4,830,204 | 5/1989 | Lin | 220/708 |
| 5,018,635 | 5/1991 | Whittaker . | |
| 5,071,019 | 12/1991 | Sizemore . | |
| 5,727,734 | 3/1998 | Su | 220/709 |
| 5,791,510 | 8/1998 | Paczonay | 220/703 |
| 5,819,972 | 10/1998 | Puente Pubill | 220/705 |
| 5,823,422 | 10/1998 | Collier et al. | 220/707 |

*Primary Examiner*—Stephen P. Garbe
*Assistant Examiner*—Niki M. Eloshway
*Attorney, Agent, or Firm*—Michael F. Kroll

[57] ABSTRACT

A beverage container cover for preventing the introduction of any contaminants into a beverage container. The beverage container cover includes a sealing layer including a top side and a bottom side, a straw extending on either side of the sealing layer and able to prevent a contaminant from passing therethrough and an adhesive substance extending about a periphery of the bottom side of the sealing layer for forming a seal with a rim of the container. A lip extends about a periphery of the top side for engaging the rim of the container and strengthening the seal therebetween. The cover further includes a first protective layer removably connected to the top side and covering a top portion of the straw and a second protective layer removably connected to the bottom side and covering the bottom side, a bottom portion of the straw and the adhesive substance. The straw may be extended whereby it extends to a base of the container.

22 Claims, 11 Drawing Sheets

8
9
36
40
46
52
53
54
56
58
60
62
32
64
66
68

DISPOSABLE ADHERING BEVERAGE CONTAINER COVER

BACKGROUND OF THE INVENTION

1. Field of the Invention

The present invention relates generally to covers for beverage containers and, more specifically, to cover for a beverage container able to adhere to the rim of the beverage container and including a tamper resistant straw extending therethrough for providing access to the beverage contained within the beverage container.

2. Description of the Prior Art

Numerous types of beverage container covers have been provided in the prior art. For example, U.S. Pat. Nos. 4,247,016; 4,615,457; 5,018,635 and 5,071,019 all are illustrative of such prior art. While these units may be suitable for the particular purpose to which they address, they would not be as suitable for the purposes of the present invention as heretofore described.

U.S. Pat. No. 4,247,016

Inventor: Jack B. Shaw

Issued: Jan. 27, 1981

A lid-straw combination with the straw being of pleated form and with most of its length wrapped around the inner periphery of a drink-container lid, one end of the straw passing through the lid, with removable cover sheets provided over both the protruding portion and the entire upper surface of the lid to maintain a sanitary condition.

U.S. Pat. No. 4,615,457

Inventor: Richard D. Harding

Issued: Oct. 7, 1986

A flexible plastic removable lid apparatus for a disposable glass or cup having a horizontally disposed circular member constructed of a semi-rigid flexible plastic material. The edges of the circular member have an annular downwardly depending flange attached thereto for extending over the edge of such glass or cup. An upper tubular connector is connected to the central top portion of the circular member and a lower short tubular connector member is connected to the bottom central portion of the circular member. These two tubular connector members are in fluid communication with each other. A first upper straw is glued in an arcuate position to the top of the circular member and this upper straw can be removed and placed on the upper connector member to produce an upper straw section. Similarly a lower straw member is glued to the bottom of the circular member and it can be removed therefrom when necessary to frictionally and sealingly fit on the lower tubular connector member to thereby produce a combination lid and straw which extends into the liquid within the cup and extends upwardly so that a person can suck the liquid out through the straw. Arrangement of the upper straw as it is glued to the top of the circular member form is in a smaller arc while the position of the straw is formed in a larger arc on the lower straw. Additionally, the upper tubular connector member is larger than the lower tubular connector member is larger than the lower tubular connector member so that these combination lids and straws can be stacked one on top of the other in a compact fashion.

U.S. Pat. No. 5,018,635

Inventor: Michael T. Whitaker

Issued: May 28, 1991

A fluid containment and access device for use with a beverage container having an upper, beaded rim and an opening for flow of the fluid contents from within the volume of the container includes a flexible lid, an integral straw and a vent with closure. The lid fits securely upon the top of the beverage container to form a fluid-tight seal. The straw has a first end extending above the lid and a second end that extends through the opening substantially to the bottom of the container. The vent closure is moveable between a first position to permit the flow of air into the container and a second position to prevent the flow of air into the beverage container.

U.S. Pat. No. 5,071,019

Inventor: David W. Sizemore

Issued: Dec. 10, 1991

A lid-straw assembly installable on an opened beverage can to facilitate the process of drinking the liquid beverage from the can. The lid includes a peripheral rim wall that snaps down around the upper edge of the can to mount the lid on the can; the rim wall seals against leakage across the can-lid interface. A hollow drinking straw extends through the lid so that a portion of the straw is exposed for drinking purposes; a second portion of the straw extends downwardly into the can for extraction of liquid from the can.

SUMMARY OF THE PRESENT INVENTION

The present invention relates generally to covers for beverage containers and, more specifically, to cover for a beverage container able to adhere to the rim of the beverage container and including a tamper resistant straw extending therethrough and providing access to the beverage contained within the beverage container.

A primary object of the present invention is to provide a beverage container cover that will overcome the shortcomings of prior art devices.

Another object of the present invention is to provide a beverage container cover which is able to prevent tampering with the contents contained in the beverage container.

A further object of the present invention is to provide a beverage container cover which is made of a malleable material and thereby able to be folded around a rim of the beverage container.

A yet further object of the present invention is to provide a beverage container cover wherein the undersurface of the cover is coated with an adhesive material for forming a seal with the rim of the beverage container.

A still further object of the present invention is to provide a beverage container cover including a tamper proof straw extending through a central portion of the cover.

An additional object of the present invention is to provide a beverage container cover wherein the straw has an outer cylindrical layer and a plurality of inner cylindrical tubes positioned within and extending through the length of the outer cylindrical layer, each inner cylindrical tube having a circumference a fraction of that of the outer cylindrical layer.

A further object of the present invention is to provide a beverage container cover wherein the straw has a circumference small enough to prevent the introduction of a substance therethrough thereby eliminating the possibility of the contents of the container from being contaminated.

A still further object of the present invention is to provide a beverage container cover including a tamper resistant feature able to alert the user to any tampering with the cover.

A yet further object of the present invention is to provide a beverage container cover including a tab extending from the periphery thereof for aiding in the removal of the cover from a container after use.

Another object of the present invention is to provide a beverage container cover that is simple and easy to use.

A still further object of the present invention is to provide a beverage container cover that is economical in cost to manufacture.

Additional objects of the present invention will appear as the description proceeds.

A beverage container cover for preventing the introduction of any contaminants into a beverage container is disclosed by the present invention. The beverage container cover includes a sealing layer including a top side and a bottom side, a straw extending on either side of the sealing layer and able to prevent a contaminant from passing therethrough and an adhesive substance extending about a periphery of the bottom side of the sealing layer for forming a seal with a rim of the container. A lip extends about a periphery of the top side for engaging the rim of the container and strengthening the seal therebetween. The cover further includes a first protective layer removably connected to the top side and covering a top portion of the straw and a second protective layer removably connected to the bottom side and covering the bottom side, a bottom portion of the straw and the adhesive substance. The straw may be extended whereby it extends to a base of the container.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims,

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figures 7, 7A, 7B:
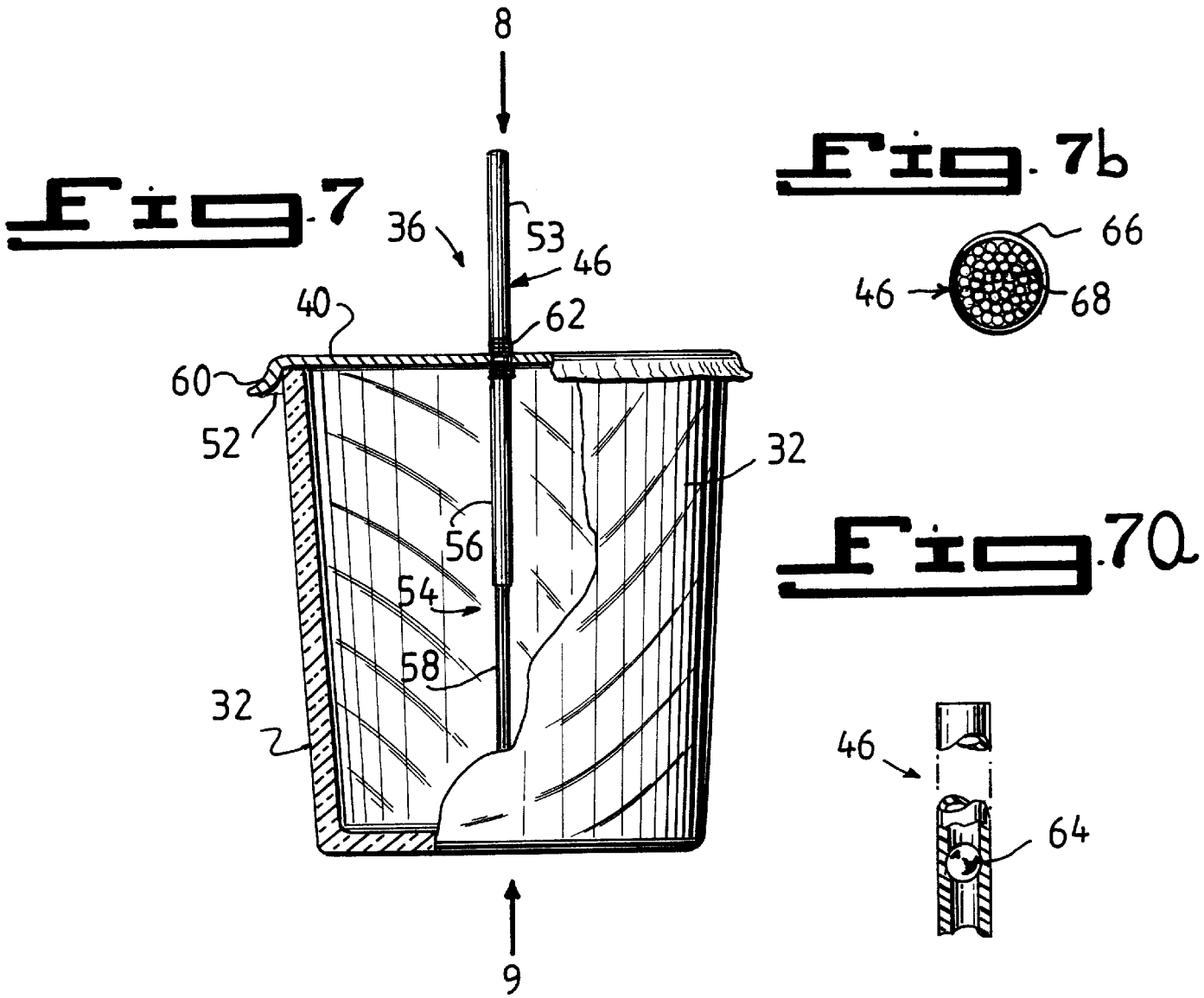
FIG. 7 is a side view in partial cross-section of the beverage container cover of the present invention positioned atop a beverage container.
Figure 5:
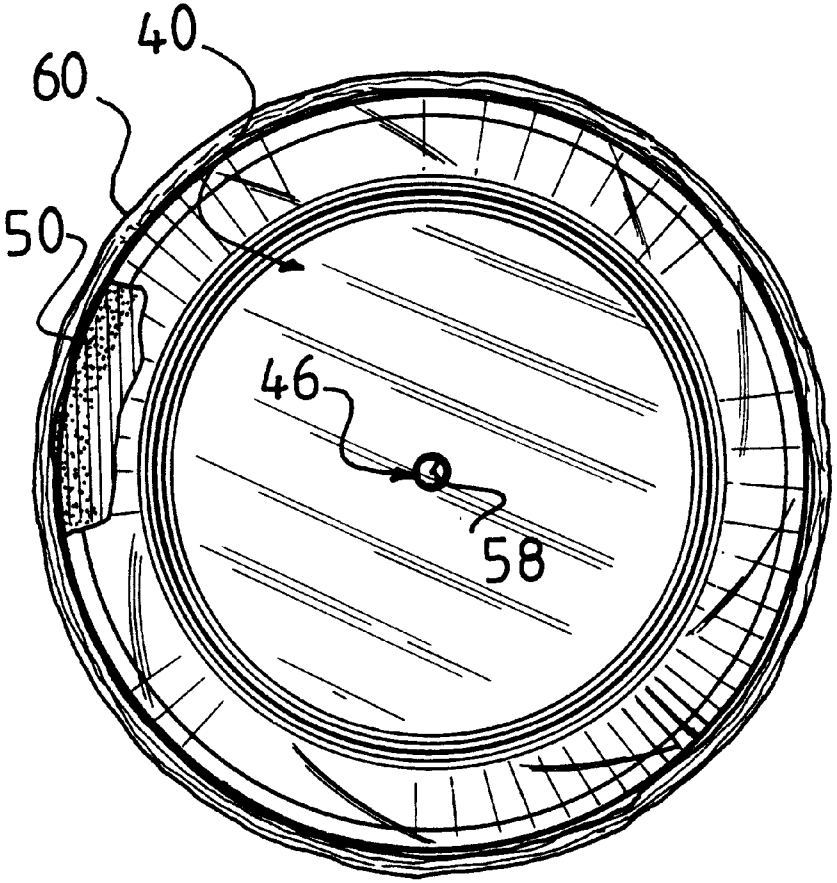
Figure 8:
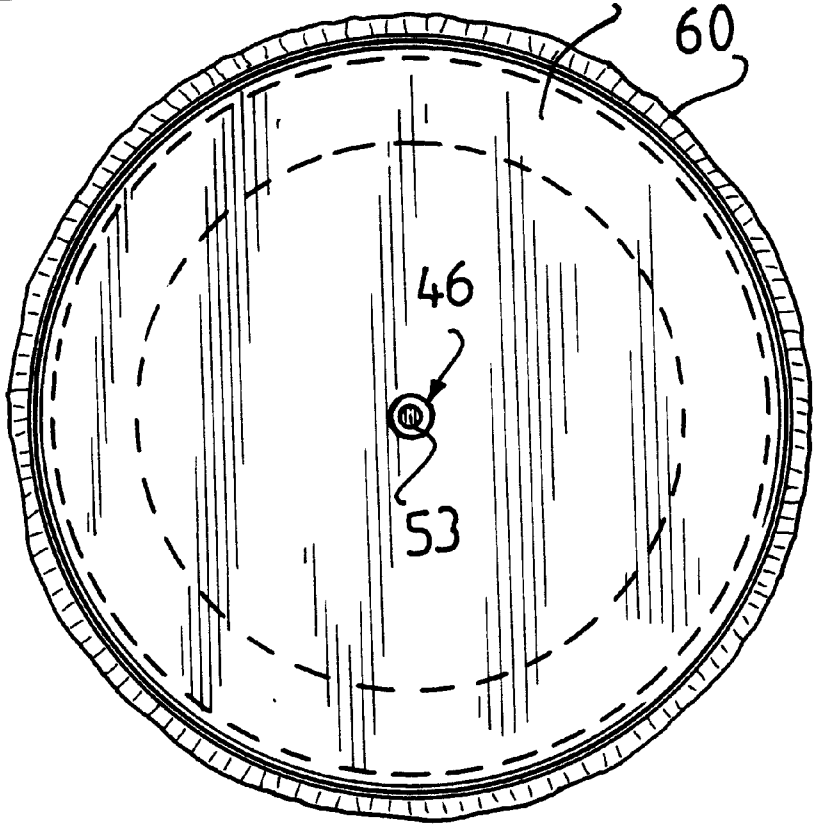
Figure 10:
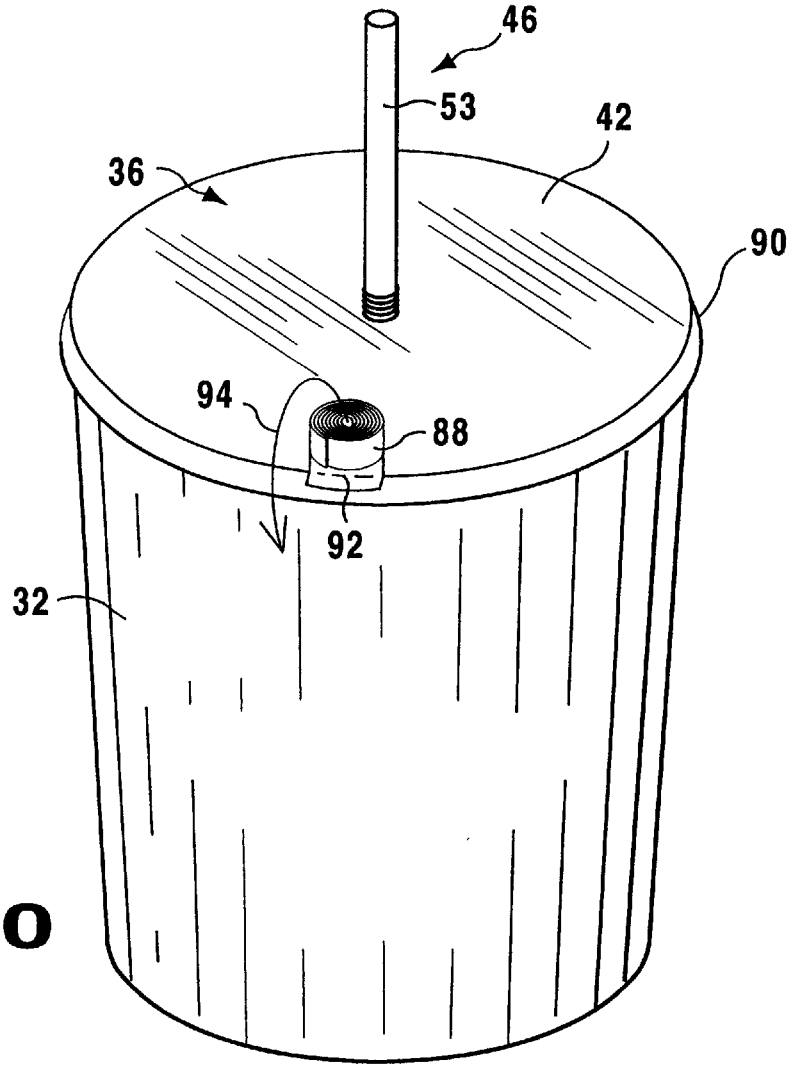
Figure 10A:
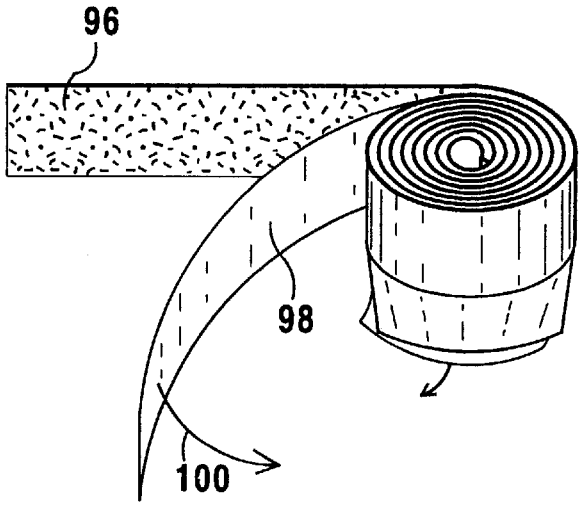
Figure 11:
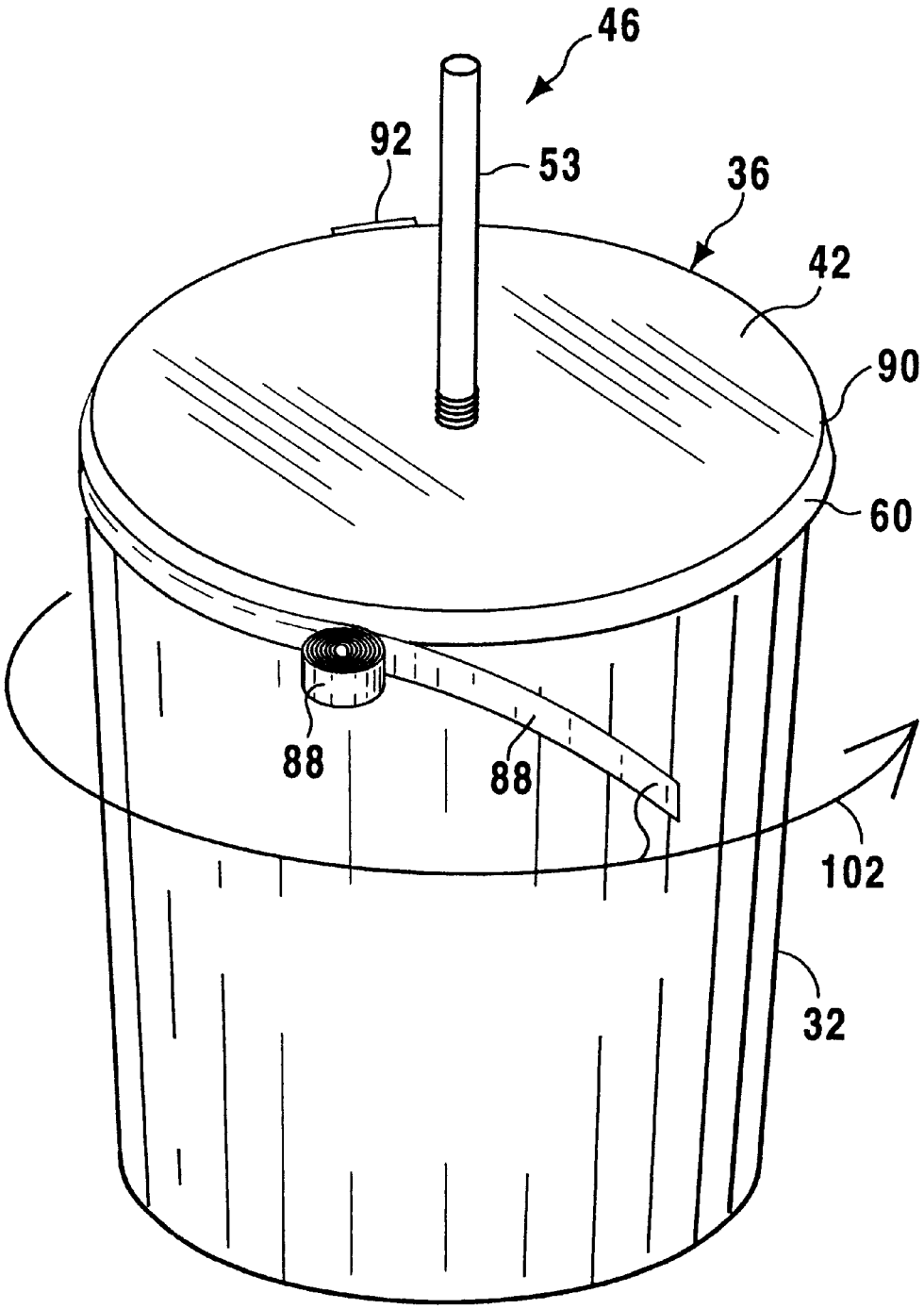
Figure 12:
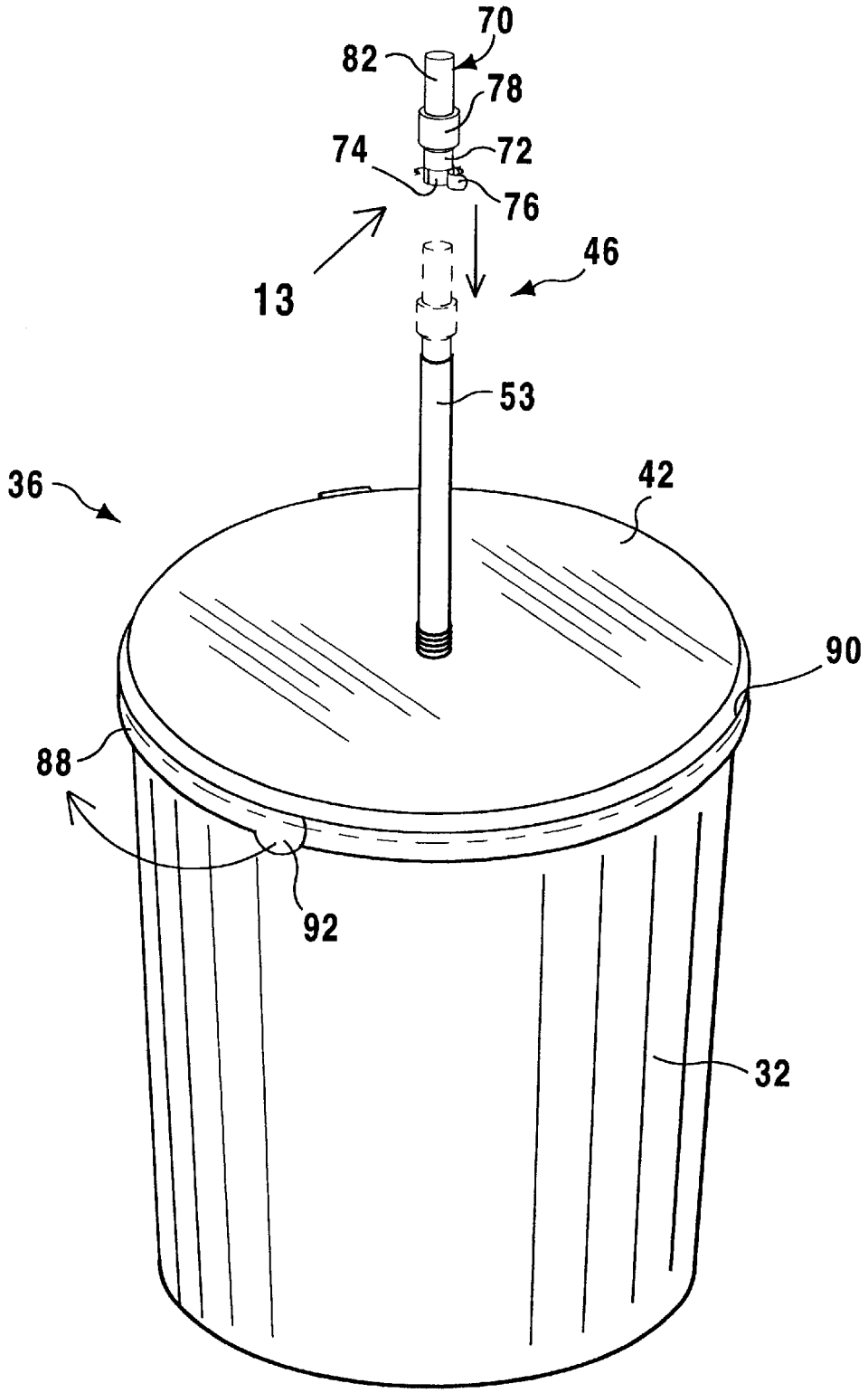
Figure 13:
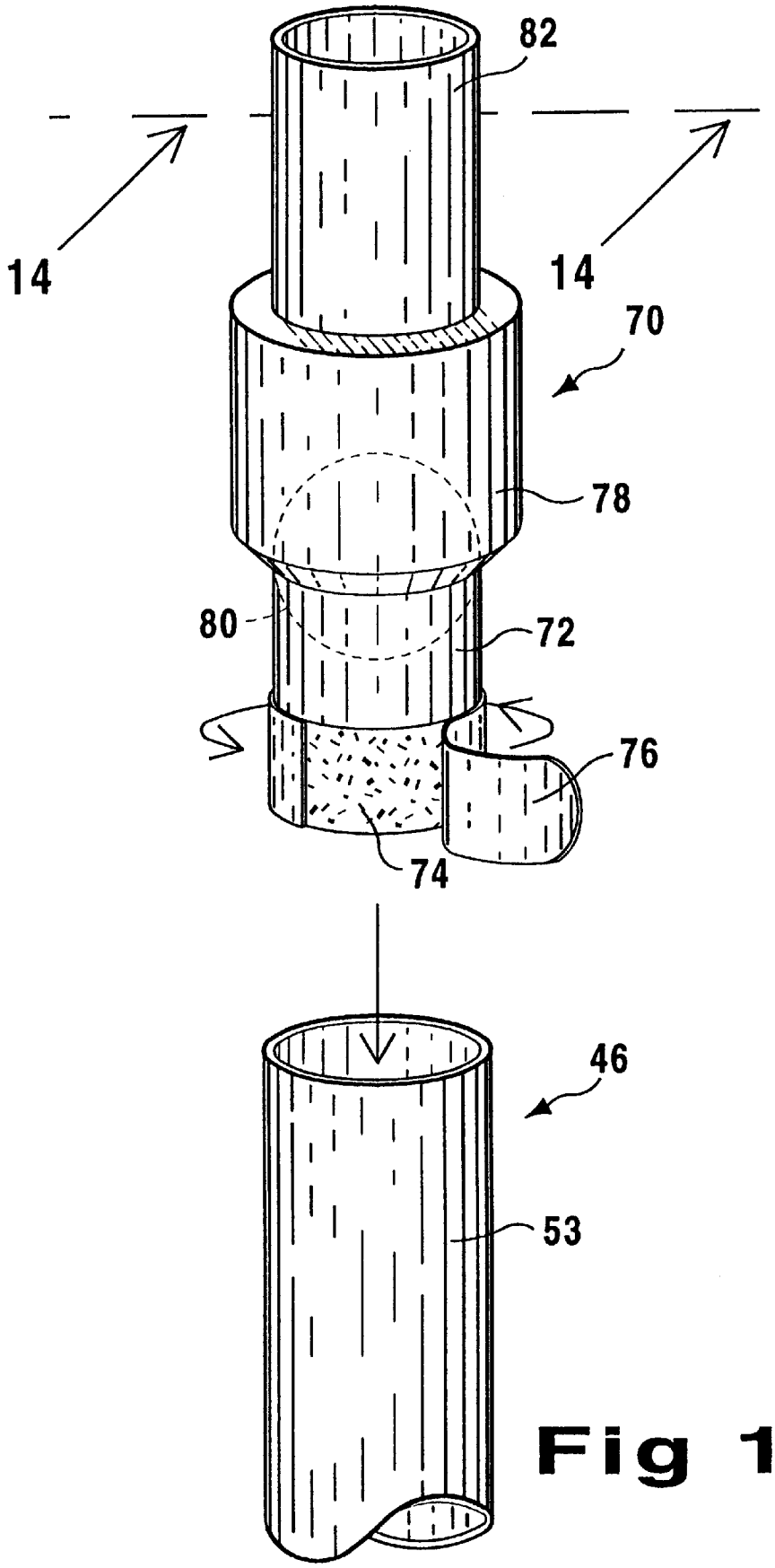
Figure 14:
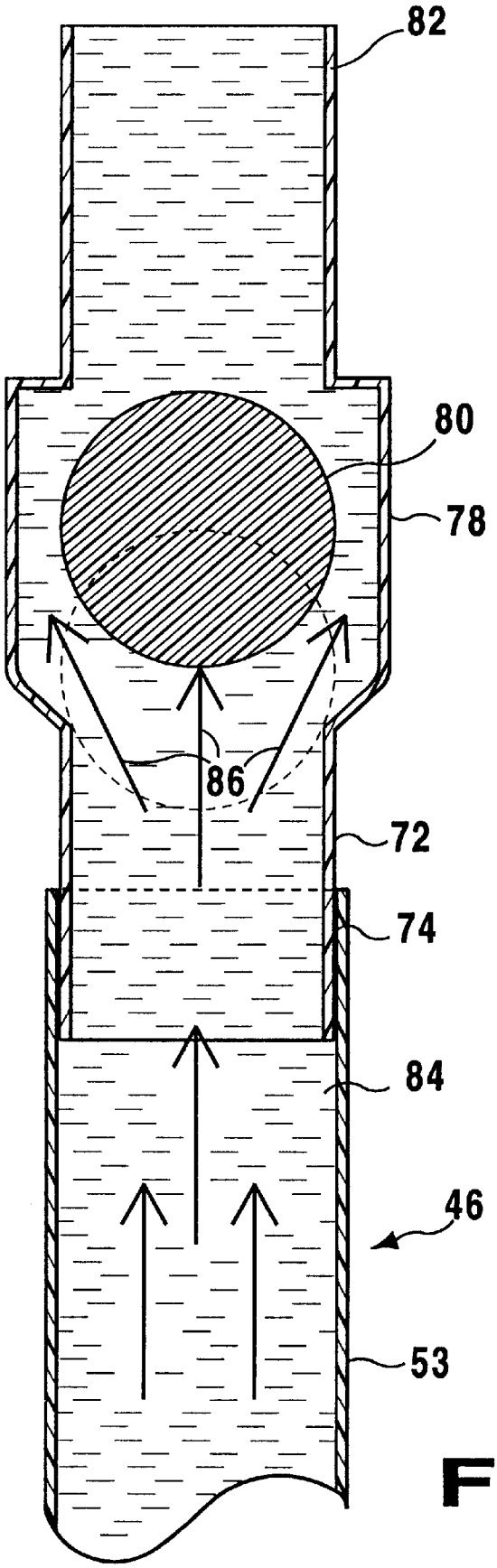

FIG. 7*a* is a side view in partial cross-section of the straw of the beverage container cover of the present invention;

FIG. 7*b* is a top view of one embodiment of a straw for use with the beverage container cover of the present invention;

FIG. 8 is top view of the beverage container cover of the present invention taken in the direction of the arrow labeled 8 in FIG. 7;

FIG. 9 is bottom view of the beverage container cover of the present invention positioned atop a clear beverage container taken in the direction of the arrow labeled 9 in FIG. 7;

FIG. 10 is a top perspective view of the beverage container cover of the present invention including a rolled up adhesive strip positioned thereatop for securing the cover to a beverage container;

FIG. 10A is an enlarged top perspective view of the adhesive strip shown in FIG. 10 in a partially unrolled state;

FIG. 11 is a top perspective view of the beverage container cover of the present invention positioned atop a beverage container and including the adhesive strip being partially applied to seal the cover to the beverage container;

FIG. 12 is a top perspective view of the beverage container cover of the present invention positioned atop a beverage container including the adhesive strip and an alternate embodiment for the straw;

FIG. 13 is a top perspective view of the alternate embodiment of the straw shown in FIG. 12 for use with the beverage container cover of the present invention; and FIG. 14 is a cross-sectional view of the alternate embodiment of the straw shown in FIG. 13 for use with the beverage container cover of the present invention.

DESCRIPTION OF THE REFERENCED NUMERALS

Turning now descriptively to the drawings, in which similar reference characters denote similar elements throughout the several views, the Figures illustrate the beverage container cover of the present invention. With regard to the reference numerals used, the following numbering is used throughout the various drawing figures.

10 bar area in which numerous beverages are served
12 bartender
14 bar
16 group of people
18 person reaching for beverage
20 container holding beverage therein
22 hand of person placing beverage container on bar
24 beach area
26 person lying on beach
28 towel
30 sand
32 beverage container spilling over
34 contents previously within beverage container
36 beverage container cover of the present invention
38 opening on top side of beverage container
40 sealing layer
42 first protective layer
44 second protective layer
46 straw
48 tab on second protective layer
50 adhesive surface
52 rim of beverage container
53 top portion of straw
54 underside of straw

56 first section of underside of straw
58 second section of underside of straw
60 lip extending around periphery of sealing layer
62 midsection of straw
64 substance stuck within straw
66 outer layer of straw
68 inner circular members of straw
70 blocking device
72 base portion of blocking device
74 adhesive substance extending around base portion
76 protective layer positioned atop adhesive substance
78 mid section
80 obstruction
82 top portion
84 liquid within beverage container
86 arrows indicating flow of liquid out of beverage container and through straw
88 adhesive strip
90 edge of cover
92 adhesive tab
94 adhesive substance on adhesive roll
96 protective layer covering adhesive substance on adhesive roll
98 arrow indicating flipping of adhesive roll
100 arrow indicating removal of protective layer from adhesive substance
102 arrow indicating winding of adhesive roll around beverage container

DETAILED DESCRIPTION OF THE PREFERRED EMBODIMENT

Figure 1:
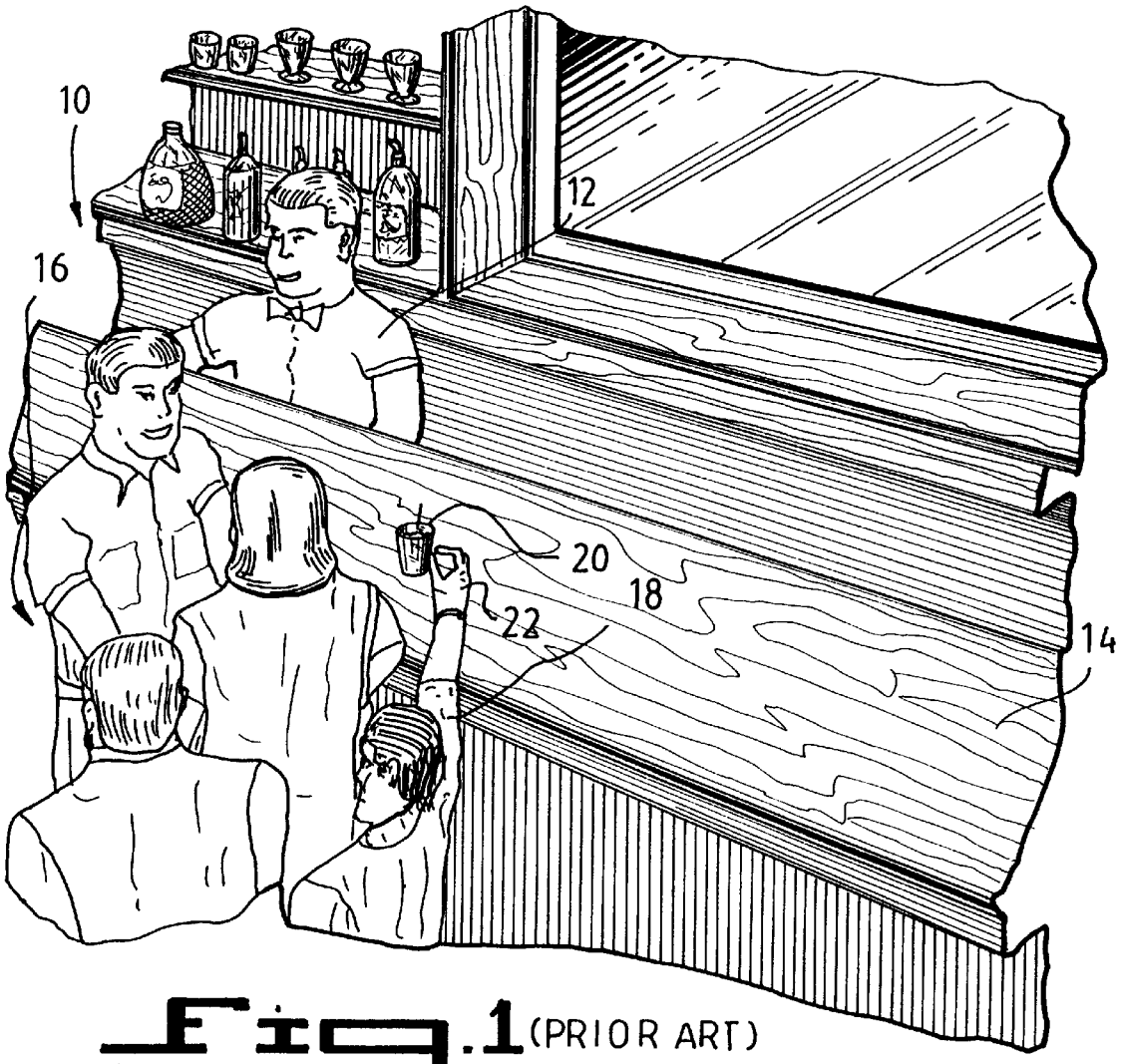
Fig. 1 (PRIOR ART)
FIG. 1 is a perspective view of a bar with a conventional uncovered cup positioned thereon.
Figure 2:
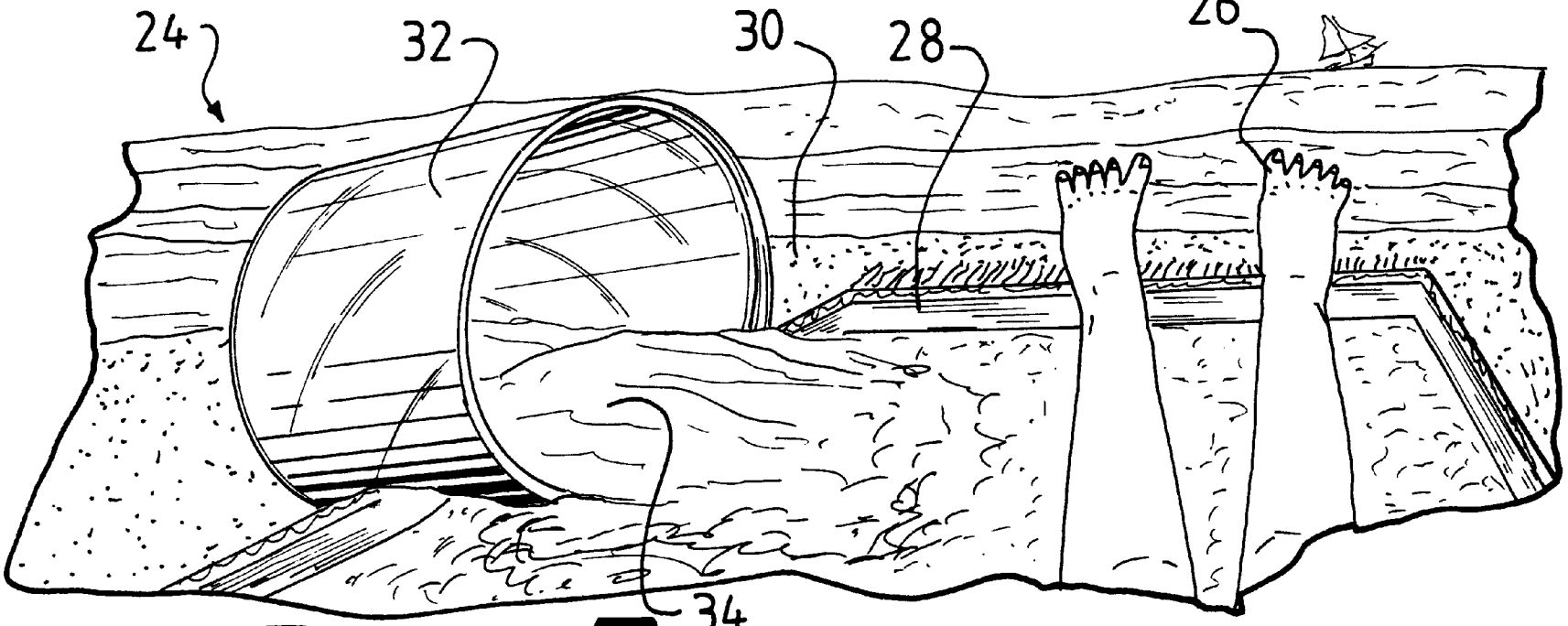
FIG. 2 (PRIOR ART)
FIG. 2 is a perspective view of a person at the beach with a conventional uncovered cup spilling all over the persons belongings.

Turning now descriptively to the drawings, in which similar reference characters denote similar elements throughout the several views, FIGS. 1 and 2 illustrate situations which the present invention is designed to prevent.

FIG. 1 illustrates a typical scene at a bar indicated generally by the number 10. As is shown in the figure, there is a bartender 12 positioned behind the bar 14. A number of patrons 16 are on an opposing side of the bar 14 and one patron 18 is resting his drink/beverage container 20 atop the bar 14. In this position the beverage container 20 is accessible to numerous ones of the patrons 16 around which the one patron 18 must reach to retrieve his beverage. As numerous patrons have access to the beverage container 20 which is uncovered, any one of them may place a contaminant either intentionally or unintentionally into the beverage container 20 thus making it undrinkable. Furthermore, as the one patron 18 must reach around numerous other patrons 16 to retrieve his beverage container 20, there is a possibility of spillage or the accidental knocking the beverage container 20 from the hand 22 of the patron 18.

FIG. 2 illustrates a scene at a beach 24. In this figure, a person 26 is lying on a towel 28 in the sand 30. A beverage container 32 is positioned adjacent the towel 28 providing a liquid refreshment for the person 26. When a container 32 is placed on the sand 30, it is prone to tipping over and spilling the contents 34 therein. This will cause a mess and possibly damage the towel 28 and the clothing of the user 26. Furthermore, since the container 32 is not adequately covered, contaminants such as sand and other objects present at the beach may enter the container 32 and mix with the contents 34.

The present invention is designed to prevent such mishaps from occurring. FIGS. 3–14 illustrate the beverage container cover of the present invention indicated generally by the numeral 36. As can be seen from this figure the beverage container cover 36 is sized to fit over an opening 38 of a container 32. The beverage container cover 36 includes a sealing layer 40 positioned between first and second protective layers 42 and 44, respectively. A straw 46 extends on either side of the sealing layer 40. On a top side of the sealing layer 40, the straw 46 is positioned between the sealing layer 40 and the first protective layer 42 and on a bottom side of the sealing layer 40, the straw 46 is positioned between the sealing layer 40 and the second protective layer 44. The second protective layer 44 includes a tab 48 for removing the second protective layer 44 from its engagement with the sealing layer 40.

Figures 3, 4:
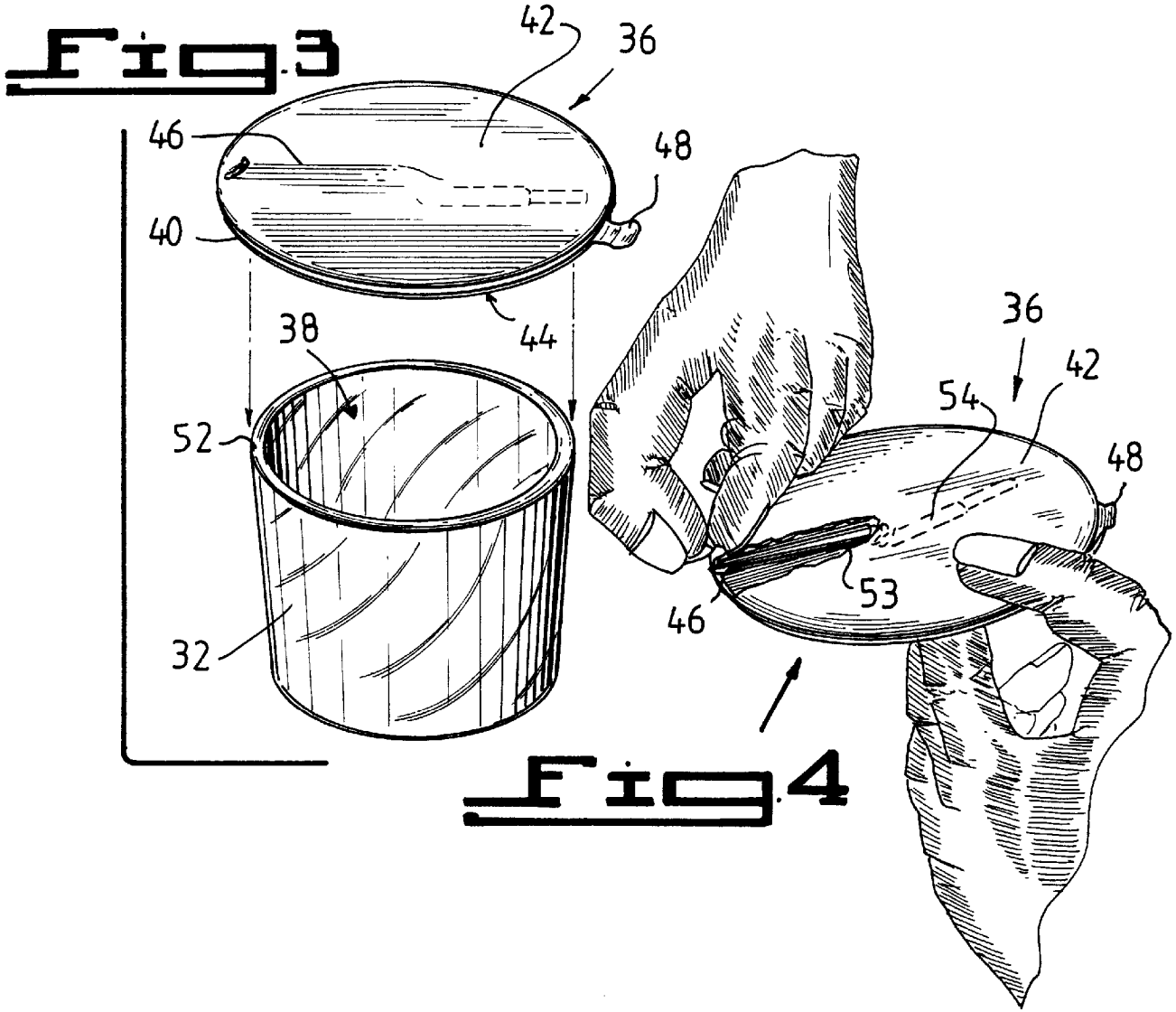
FIG. 3 is an enlarged top perspective view of the beverage container cover of the present invention removed from its position covering a beverage container.
FIG. 4 is a top perspective view of the beverage container cover of the present invention, showing a user removing a protective layer thereon to reveal a straw positioned therebelow.
Figure 5:
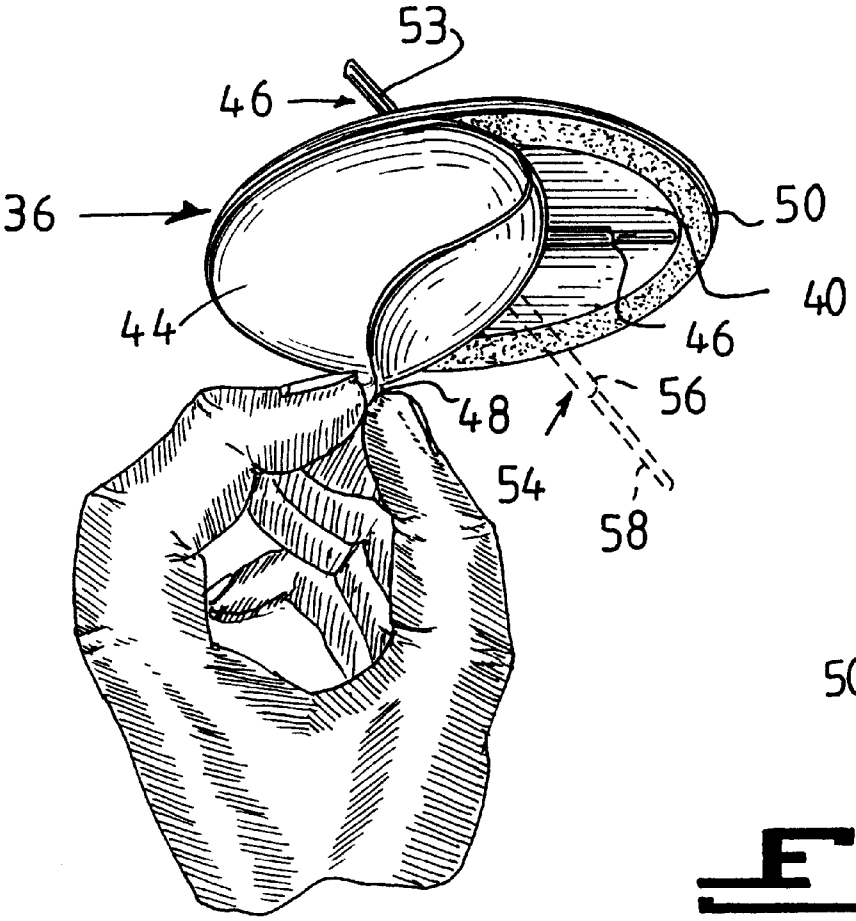
FIG. 5 is a bottom perspective view of the beverage container cover of the present invention illustrating a user removing a protective layer to reveal an adhesive material for forming a seal with a rim of the beverage container and a bottom end of a straw positioned below the protective layer.

As is illustrated in FIG. 3, the straw 46 extends on either side of the sealing layer 40, the portion of the straw 46 extending on the bottom side of the sealing layer 40 is illustrated in dashed lines. Positioned on the bottom side and extending around the periphery of the sealing layer 40 is an adhesive substance 50 for forming a releasable seal with a rim 52 of any container 32 on which it is placed as is illustrated in FIG. 5.

The beverage container cover 36 may be formed to fit and seal any size top of any beverage container. The size illustrated in the drawings is for purposes of example only and not meant to limit the invention to a cover a single size beverage container 32. The beverage container cover 36 is made of a malleable material able to bend to the shape of the container 32 for ease in securing the beverage container cover 36 atop the container 32.

The first protective layer 42 is formed from a thin sheet of material which is easily pierced when a pressure is applied thereto. Preferably the first protective layer 42 is formed from a thin piece of foil such as aluminum foil. However, any thin, easily pierceable material such as paper, wax coated paper, tissue, etc . . . may be used. The second protective layer 44 is made of a thicker material than the first protective layer 42 as the material must be able to be completely removed from the bottom side of the sealing layer 40 and not remain in contact with the adhering substance 50. Such materials for the second protective layer include but are not limited to cardboard, a thin flexible plastic, any flexible polymeric substance, a foil layer, paper, wax coated paper, etc . . .

FIG. 4 illustrates the manner of exposing the portion of the straw 46 extending on the top side of the sealing layer 40 for use. In order to expose the top portion 53 of the straw 46 extending on the top side of the sealing layer 40, either the first protective layer 42 may be punctured by applying pressure to the straw 46 and forcing it through the first protective layer 42 or tearing the protective layer at a position above the location of the straw 46. The straw 46 may then be lifted into the desired position for drinking therefrom.

Removal of the second protective layer 44 for exposing both the adhesive substance 50 and an underside 54 of the straw 46 is illustrated in FIG. 5. As can be seen from this figure, in order to remove the second protective layer 44 a user will grab the tab 48 and pull back on the tab 48 across the surface of the sealing layer 40. This will cause the second protective layer 44 to be peeled from the sealing layer 40 thus exposing both the adhesive substance 50 and the underside 54 of the straw 46. The second protective layer 44 must be strong enough to not tear under the pressure applied during removal from the sealing layer 40 and breaking of the bond formed with the adhesive substance 50.

Figure 6:
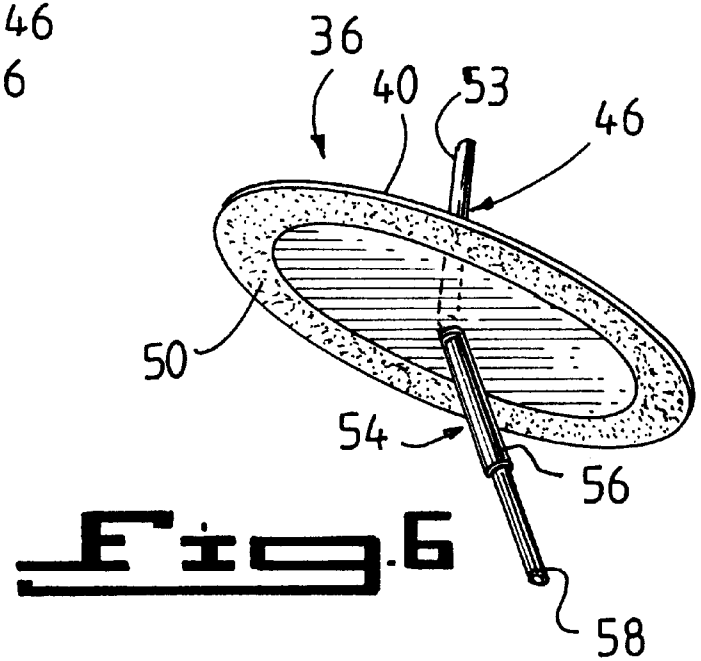
FIG. 6 is an enlarged bottom perspective view of the beverage container cover of the present invention with the protective layers removed.

The underside 54 of the straw 46 is extendible as illustrated in dashed lines in FIG. 5. The underside 54 of the straw 46 is formed from at least two interlocking sections. A first section 56 is an extension of the top portion 53 of the straw 46 extending on the opposite side of the sealing layer 40 and a second section 58 slideably positioned therein. The first section 56 has a circumference greater than the circumference of the second section 58 and receives the second section 58 therein. Additional sections may be added to increase the potential length of the straw 46. Each subsequent section will have a smaller circumference than the section from which it depends whereby the subsequent section may be received within its depending section when the straw 46 is in its unextended state. The underside 54 of the straw 46 is illustrated in its fully extended position in dashed lines in FIG. 5. A bottom perspective view of the sealing layer 40 and straw 46 with the second protective layer 44 removed and the underside of the straw in its extended position is also illustrated in FIG. 6.

A side partial cross-sectional view of the beverage container cover 36 positioned atop a beverage container 32 is illustrated in FIG. 7. From this view, it can be seen that the straw 46 will extend to the bottom of the container 32 in its extended position. A lip 60 is also illustrated as extending about a periphery of the sealing layer 40 for engaging the rim 52 of the container and increasing the force of the seal formed therebetween. In this figure, the straw 46 is also illustrated as having an accordion type midsection 62 allowing the straw 46 to extend even further beyond its normal length and allowing the user to position the top portion 53 of the straw 46 at a comfortable angle for drinking therethrough.

One embodiment of the straw 46 is illustrated in FIG. 7*a* and illustrates a straw 46 having a circumference able to prevent a substance 64 from passing therethrough. As the circumference of the straw 46 is substantially narrow objects of any dimension are unable to pass therethrough without an additional force, e.g. a user blowing into the straw, being applied thereto. This will prevent the possibility of contamination as the need for the additional force is a significant deterrent to intentional contamination and any substance which may somehow unintentionally enter the straw 46 will not have the additional force needed to pass therethrough readily at its disposal. Such substances will thus be trapped within the straw 46 and easily detected by the user.

Another possible embodiment for the straw 46 is illustrated in FIG. 7*b*. This embodiment encompasses an outer cylindrical layer 66 and a plurality of inner cylindrical layers 68 extending therethrough. Each of the plurality of inner cylindrical layers 68 having a circumference smaller than that of the outer cylindrical layer 66. The inner cylindrical layers 68 are of a circumference able to prevent any contaminant from passing therethrough while allowing the user to drink from the container 32.

A further embodiment for the straw is illustrated in FIGS. 12–14 and includes a blocking device 70 which is able to lock into the top section 53 of the straw 46. The blocking device 70 includes a base portion 72 having a circumference slightly smaller than the circumference of the top section 53 of the straw 46 allowing the base portion 72 to be inserted therein. An adhesive material 74 is positioned around an outer side of the base portion 72 and a protective layer 76 covers the adhesive material 74 until it is desired to use the blocking device 70. The adhesive material 74 secures the blocking device 70 to the straw 46 when inserted therein. A mid section 78 extends from the base portion 72 and has a larger circumference than the base portion 72. As can be seen from FIGS. 13 and 14, an obstruction 80 is positioned within the mid section 78. Extending from the mid section 78 is a top portion 82 having a circumference substantially equal to the circumference of the base portion 72. The blocking device can be manufactured as one piece within the straw.

As can be seen from these figures, when the protective layer 76 is removed from its position covering the adhesive substance 74 and the base portion 72 is inserted into the top section 53 of the straw 46, the adhesive substance 72 will engage with the inner side of the top section 53 and secure the blocking device 70 atop the straw 46. Furthermore, the obstruction 80 positioned within the midsection 78 allows the liquid 84 within the beverage container 32 to pass thereby as indicated by the arrows labeled 86 while preventing any contaminant from passing into the straw 46 and thus into the beverage container 32. FIG. 12 also illustrates an adhesive strip 88 extending around the edge 90 of the cover 36 for securing the cover 36 to the beverage container 32.

The adhesive strip 88 is also illustrated in FIGS. 10, 10A and 11. In FIGS. 10 and 10A the adhesive strip 88 is illustrated in a rolled up state. The adhesive strip 88 is rolled up prior to use and is attached to the edge 90 of the cover 36 by an adhesive tab 92, positioned on a top side 42 thereof. When it is desired to seal the cover 36 to the beverage container 32, the adhesive strip 88 is flipped over the edge 90 of the cover as indicated by the arrow labeled 94 so as to extend partially over the skirt 60 of the cover 36 and the edge of the beverage container. The adhesive strip 88 includes an adhesive substance 96 on one side thereof and a protective layer 98 covering the adhesive substance 96 prior to use. The protective layer 98 is removed from its position covering the adhesive substance 96 when it is desired to secure the cover 36 to the beverage container 32 as indicated by the arrow labeled 100. The adhesive strip 88 is then unrolled as indicated by the arrow labeled 102 and wound around the beverage container 32 and the skirt 60 of the cover 36, securing the skirt 60 to the beverage container 32.

Should an attempt to remove the beverage container cover 36 from atop the container 32, evidence of such attempt will be evident from deformation of the beverage container cover 36. In order to remove the beverage container cover 36, it must be bent in some manner to both release the engagement of the lip 60 and the 52 of the container 32 and to release the seal formed by the adhesive substance 50. This bending will cause creases to form in the sealing layer 40 or even the formation of cracks extending through the sealing layer 40. From such evident signs the user will be able to determine that the beverage container cover 36 has been tampered with.

A top view of the beverage container cover 36 positioned atop a container is illustrated in FIG. 8 and a bottom view of the beverage container cover 36 positioned atop a container is illustrated in FIG. 9. From FIG. 8 the engagement of the lip 60 with the rim 52 of the container 32 is evident while in FIG. 9 the engagement of the adhesive substance 50 with the rim 52 is evident.

The operation of the beverage container cover 36 will now be described with reference to the figures. In operation, the beverage container cover 36 is grasped by the user and the first protective layer 42 is pierced by either pinching the material or applying a pressure to the top portion 53 of the straw 46 causing it to pierce the first protective layer 42 as illustrated in FIG. 4. The top portion 53 of the straw 46 is now exposed.

The user will now grasp the tab 48 as illustrated in FIG. 5 and peel back the second protective layer 44 causing the adhesive substance 50 and the underside 54 if the straw 46 to be exposed. The second section 58 of the underside 54 of the straw 46 will now be pulled from its position within the first section 56 of the straw 46 causing the straw 46 to be in its fully extended position. The beverage container cover 36 is now ready to be attached to a container 32.

To attach the beverage container cover 36 to a container 32, the underside 54 of the straw 46 is positioned to extend within the container 32 and the adhesive substance 50 is positioned to contact the rim 52 of the container 32. A pressure is now applied to the periphery of the beverage container cover 36 causing the lip 60 to be forced over and engage the rim 52 of the container 32. The adhesive strip 88 may now be folded over the adhesive tab 92 and unrolled, removing the protective layer 98 as it is unrolled. The adhesive substance 96 on the back side of the adhesive strip 88 is pressed against the skirt 60 of the cover 36 and the rim of the beverage container 32, sealing the cover 36 to the beverage container 32. The beverage container cover 36 is now sealed to the container 32, preventing any substance within the container 32 from contamination. The protective cover 76 may now be removed from the base portion 72 of the blocking device 70 thereby exposing the adhesive substance 74. The base portion 72 is now inserted within the top section 53 of the straw 46 and secured therein by the adhesive substance 74. The user will now use the straw 46 to drink the substance within the container 32 as done with any conventional straw 46.

When the container is empty the user may then remove the beverage container cover 36 by applying a force to the beverage container cover 36 in a direction away from the container 32 causing the seal formed between the lip 60, adhesive substance 50 and the rim 52 to be broken.

From the above description it can be seen that the beverage container cover of the present invention is able to overcome the shortcomings of prior art devices by providing a beverage container cover which is able to prevent tampering with the contents of the beverage container protected by the cover and is made of a malleable material and thereby able to be folded around a lid of the beverage container. The beverage container cover includes an undersurface coated with an adhesive material for forming a seal with the lid of the beverage container on which it is placed and a tamper proof straw extending through a central portion of the cover. The straw of the beverage container cover has an outer cylindrical layer and a plurality of inner cylindrical tubes each having a circumference a fraction of that of the outer cylindrical layer extending through the outer cylindrical layer and the straw has a circumference able to prevent the introduction of a substance therethrough thereby eliminating the possibility of any beverage within the container from being contaminated. Furthermore, the beverage container cover of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A beverage container cover for preventing the introduction of any contaminants into a beverage container, said beverage container cover comprising:

a) a sealing layer including a top side and a bottom side, said sealing layer further including a lip extending about a periphery of said top side for engaging a rim of the container;

b) a straw extending on either side of said sealing layer and able to prevent a contaminant from passing therethrough, said straw having a bottom portion extending on said bottom side of said sealing layer;

c) an adhesive substance extending about a periphery of the bottom side of the sealing layer for forming a seal with the rim of the container; and d) a second protective layer removably connected to said bottom side and covering said bottom side, said bottom portion of said straw and said adhesive substance.

2. The beverage container cover as recited in claim 1, wherein said straw has a top portion extending on said top side of said sealing layer and said cover further comprises a first protective layer removably connected to said top side and covering said top portion of said straw.

3. The beverage container cover as recited in claim 2, wherein said first protective layer is made of a thin easily pierceable material.

4. The beverage container cover as recited in claim 3, wherein said thin easily pierceable material is one of paper, wax coated paper and tissue paper.

5. The beverage container cover as recited in claim 2, further comprising a sealing device including a base section having an adhesive substance extending around an outer side thereof, said sealing device having a circumference substantially equal to a circumference of said straw wherein when said sealing device is positioned such that said base section extends within said top section of said straw, said adhesive substance secures said sealing device to an inner side of said straw.

6. The beverage container cover as recited in claim 1, wherein said straw is extendible.

7. The beverage container cover as recited in claim 1, wherein said bottom portion of said straw includes a first section connected to said top portion of said straw and a second section extending from a side of said first section opposite said connection with said top portion and able to be received within said first section.

8. The beverage container cover as recited in claim 1, wherein said straw has a circumference, said circumference being of a dimension able to prevent a contaminant from passing therethrough.

9. The beverage container cover as recited in claim 1, wherein said straw further includes a first outer layer having a circumference and a plurality of inner layers positioned within said outer layer, each of said inner layers having a circumference smaller than said circumference of said outer layer.

10. The beverage container cover as recited in claim 1, wherein said straw includes a mid section, said mid section being accordion-like enabling said straw to bend in any desired position.

11. The beverage container cover as recited in claim 1, wherein said sealing layer is made of a malleable material.

12. The beverage container cover as recited in claim 1, wherein said second protective layer is formed of a flexible, bendable material.

13. The beverage container cover as recited in claim 12, wherein said flexible, bendable material is one of cardboard, a thin flexible plastic, any flexible polymeric substance, a foil layer, paper, wax coated paper.

14. The beverage container cover as recited in claim 1, wherein said straw has a top portion extending on said top side of said sealing layer and a bottom portion extending on said bottom side of said sealing layer and said cover further comprises a first protective layer removably connected to said top side and a second protective layer removably connected to said bottom side and covering said bottom side, said bottom portion of said straw and said adhesive substance.

15. The beverage container cover as recited in claim 14, wherein said first protective layer and said second protective layer each have a thickness, said thickness of said second protective layer being greater than said thickness of said first protective layer.

16. The beverage container cover as recited in claim 14, further comprising a blocking device including a base section having an adhesive substance extending around an outer side thereof, said blocking device having a circumference substantially equal to a circumference of said straw wherein when said blocking device is positioned such that said base section extends within said top section of said straw, said adhesive substance secures said blocking device to an inner side of said straw.

17. The beverage container cover as recited in claim 16, wherein said blocking device further includes a mid section extending from said base section and having a circumference greater than the circumference of said base section and an obstructive device positioned within said mid section for preventing contaminants from passing through said straw and into the container and allowing the substance within the container to pass thereby and out of the container.

18. The beverage container cover as recited in claim 17, wherein said blocking device further includes a top section extending from said mid section and having a circumference substantially equal to the circumference of said base section.

19. The beverage container cover as recited in claim 16, wherein said blocking device further includes a mid section extending from said base section and having a circumference greater than the circumference of said base section and an obstructive device positioned within said mid section for preventing contaminants from passing through said straw and into the container and allowing the substance within the container to pass thereby and out of the container.

20. The beverage container cover as recited in claim 19, wherein said blocking device further includes a top section extending from said mid section and having a circumference substantially equal to the circumference of said base section.

21. The beverage container cover as recited in claim 1, further comprising a skirt extending around said sealing layer and an adhesive strip secured to said sealing layer for securing said skirt to a top end of said container.

22. The beverage container cover as recited in claim 21, wherein said adhesive strip includes an adhesive substance on one side thereof for use in securing said skirt to a top end of said container.

* * * * *